US005961397A

United States Patent [19]

Lu et al.

[11] Patent Number: 5,961,397

[45] Date of Patent: Oct. 5, 1999

[54] HOSEL-LESS GOLF CLUB

[76] Inventors: Clive S. Lu, 282 Newbridge Rd., Hicksville, N.Y. 11801; Ming Ho Wang, 179 Jui Shing St., Kaoshiung, Taiwan

[21] Appl. No.: 09/018,793

[22] Filed: Feb. 4, 1998

[51] Int. Cl.[6] ..... A63B 53/04

[52] U.S. Cl. ..... 473/327

[58] Field of Search ..... 473/324, 327, 473/317, 305, 350; D21/733, 747

[56] References Cited

U.S. PATENT DOCUMENTS 3,572,709 3/1971 Risher .
3,819,181 6/1974 Mills .
5,184,819 2/1993 Desbiolles .
5,632,695 5/1997 Hlinka et al. .

*Primary Examiner*—Sebastiano Passaniti
*Attorney, Agent, or Firm*—Aquilino & Welsh

[57] ABSTRACT

A hosel-less shaft connection for a golf club including an airfoil shaped ledge located at the heel portion of the golf club head which is generally parallel to and below an upper surface of the club head and an upright airfoil shaped wall connecting the ledge and the upper surface. A shaft is connected to a shaft bore opening located on the airfoil shaped ledge whereby the shaft enters the club head at a point below the top surface of the club head.

10 Claims, 3 Drawing Sheets

FIG. 1
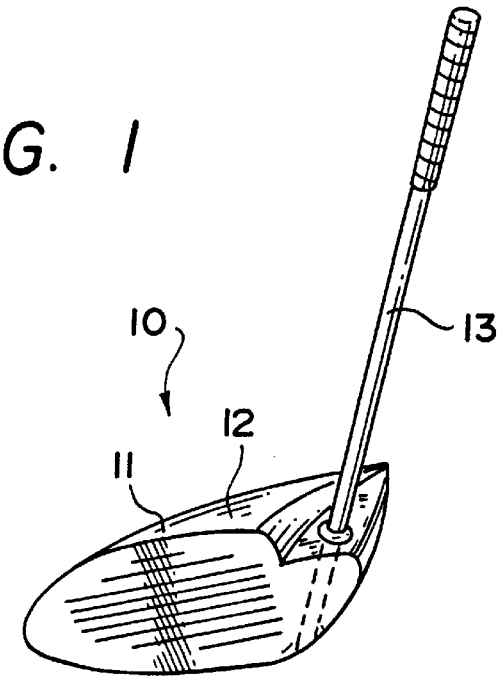
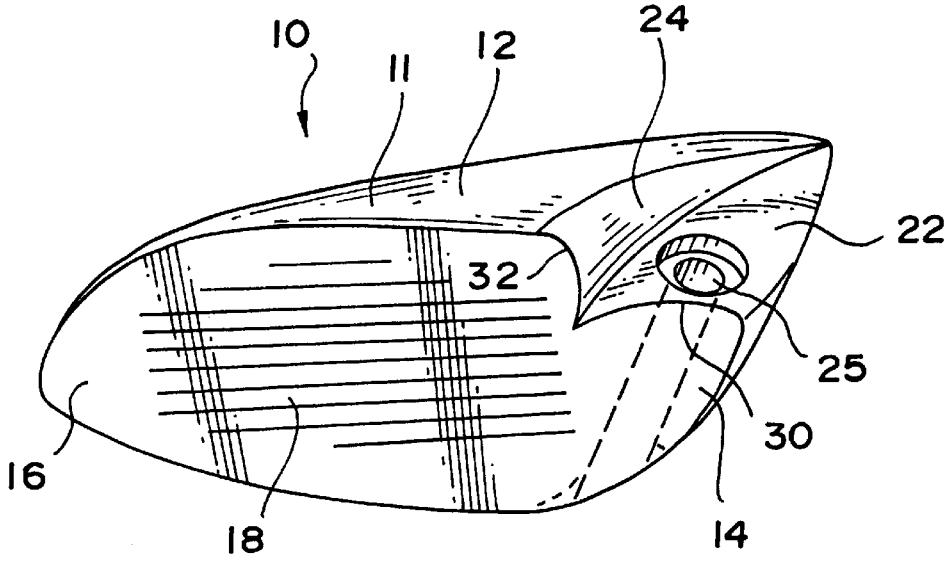
FIG. 2

FIG. 5
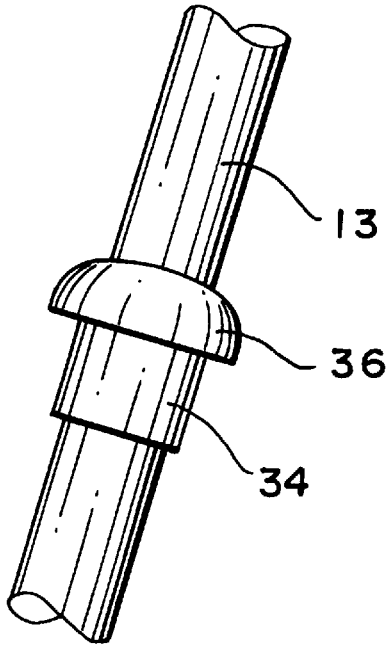
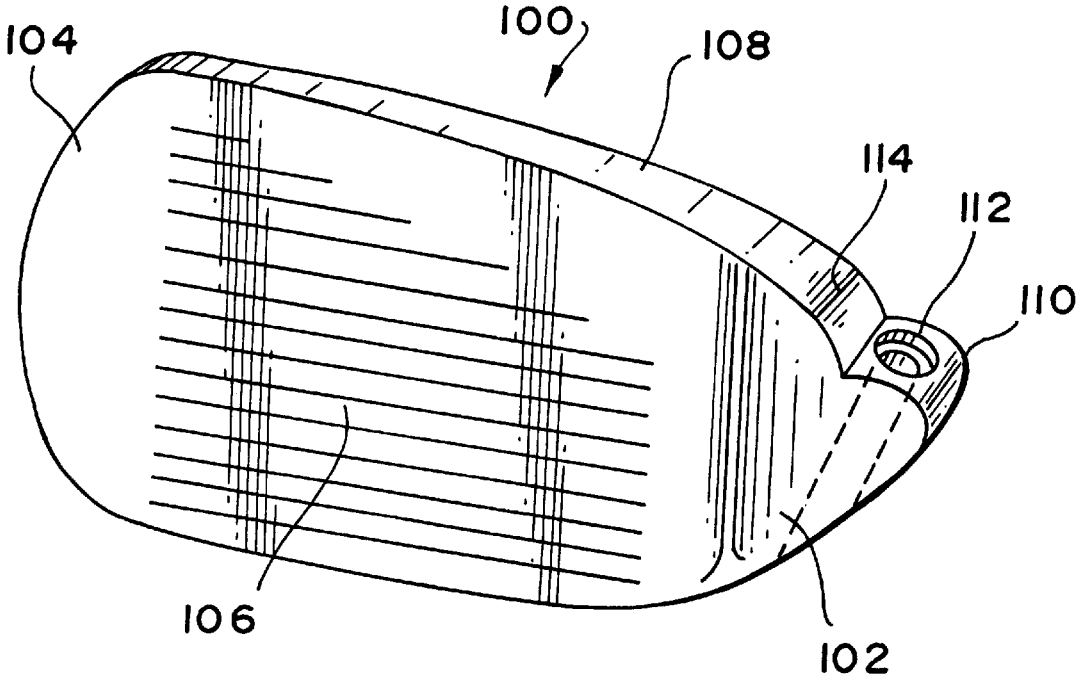
FIG. 6

HOSEL-LESS GOLF CLUB

BACKGROUND AND SUMMARY OF THE INVENTION

The present invention relates to golf clubs and, in particular, to metal wood and iron type golf club heads having an improved hosel construction.

Golf club heads conventionally include a hosel which is integrally formed and smoothly transitions into the club head body at the heel area of the club head. The lower portion of the hosel integrally connects with the crown or upper surface of the club head adjacent the heel. Other metal wood golf club heads are constructed hosel-less, that is, the hosel socket connection is formed interior of the metal shell of the club head at the heel, eliminating excessive weight in the heel area and also making a connection with the shaft, the main source of power, at a point inside the club head body shell closer to the center of percussion of the club head. This arrangement aids in eliminating bent and broken shafts caused by excessive torquing and twisting of the hosel during the execution of golf swings.

Prior art patents of interest include U.S. Pat. No. 5,632,695 to Hlinka et al., which shows a golf club head having a hosel tube extending from an inverted or recessed concave wall. The hosel tube extends upwardly for attachment to a shaft.

Another patent of interest is U.S. Pat. No. 3,572,709 to Risher which shows a golf club head which includes a flat inclined surface or space which serves as a support for a hosel structure including an outer sleeve and inner sleeve to locate and engage a shaft connected therewith.

U.S. Pat. No. 3,819,181 to Mills is an early example of a hosel-less wood type golf club head wherein the shaft is inserted into a tubular shaft retainer attached to the sole plate.

Still another patent of interest is U.S. Pat. No. 5,184,819 to Desbiolles wherein a club head is provided with a neck made separately from and fastened to the head for subsequent connection to a shaft.

The present invention is an improved hosel-less golf club. The club head structure is formed without a hosel. The shaft is connected to a lowered or sunken aerodynamic surface located below the top surface of the club head. Preferably, the connection surface is a ledge having an airfoil shape which reduces the drag at the connection between the shaft and the hosel when the club head is swung at high speeds up to and in excess of 100 miles per hour. In a preferred embodiment, the airfoil shaped ledge is substantially parallel to a heel-toe longitudinal plane between an upper surface and the bottom of the club head. The structure also includes an airfoil wall surface extending upwardly between the ledge and the top surface of the club head, whereby the wall surface and the ledge forms a generally L-shaped configuration. The shaft connection may include a ferrule which lies on the top surface of the ledge to further enhance the aerodynamic surface characteristics at the connection point.

The present aerodynamic structure is equally applicable to metal wood and iron type golf club head structures.

Among the objects of the present invention is the provision of an improved hosel structure for a golf club head having increased strength, weight distribution and stability.

Another object of the present invention is the provision of an improved hosel structure for a golf club head having superior aerodynamic characteristics.

These and other objects will become apparent with reference to the accompanying drawings and specification.

BRIEF DESCRIPTION OF THE DRAWINGS

FIG. 1 is a perspective view of a golf club in accordance with the present invention.

FIG. 2 is a perspective view of the golf club head of FIG. 1.

FIG. 5 is a partial view of a golf club shaft and mounting sleeve used with the golf club of the present invention.

FIG. 6 is a perspective view of an iron type golf club head in accordance with the present invention.

DESCRIPTION OF THE PREFERRED EMBODIMENTS

Figure 3:
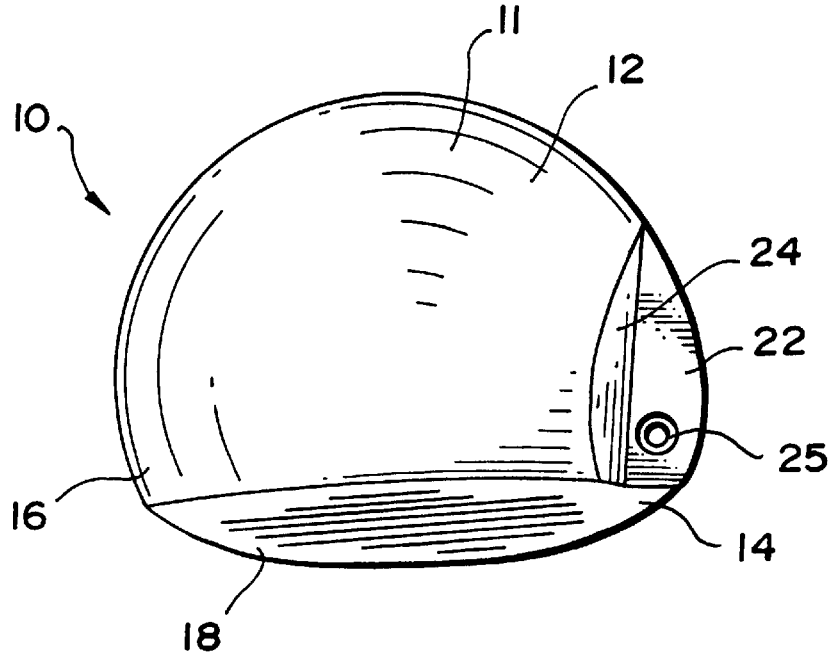
FIG. 3 is a top plan view thereof.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The drawings illustrate a golf club 10 having a club head 11 and shaft 13 in accordance with the present invention. The club head 11 includes an upper surface 12, heel 14, toe 16, ball striking face 18, bottom surface 20 and rear surface 21.

Figure 4:
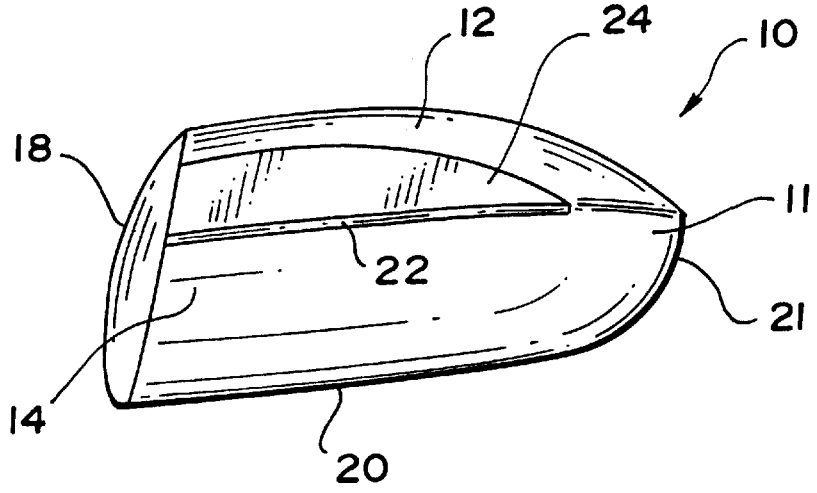
FIG. 4 is a side elevational view thereof.

As can be seen from the drawings, the club head 11 is hosel-less and the shaft connection area adjacent the heel 14 is formed of a ledge 22 substantially parallel to the upper and bottom surfaces of the club head 11 and a second upright wall 24 connecting the top surface 12 to the ledge 22 and forming an L-shaped configuration. A shaft bore opening 25 is formed in the ledge 22 for connection to a shaft 28. Preferably a shaft sleeve 34, (see FIG. 4) is placed over the shaft 13 at the opening 25 and inserted into the club head 11. Both the ledge 22 and upright wall 24 have a parabolic outer shape, which forms an airfoil along the leading edges 30 and 32 respectively adjacent the ball striking face 18 to the rear surface 21 of the club head 11.

By being below the top surface 12 of the club head 11, the shaft connection is closer to the center of the club head resulting in less torquing or twisting of the club head particularly when a golf ball is mis-hit or struck off the center of percussion. The airfoil surfaces on the ledge 22 and upright wall 24 provide an aerodynamic effect at the shaft connection area on the club head 11, decreasing air resistance and increasing stability when the club is swung at high speeds in the range of 80 to 120 miles per hour. As can be seen particularly with reference to FIG. 2, the ledge 22 and wall surface 24 are wider at the front of the club head 10 and progressively become narrower toward the rear surface 21 of the club head 11.

FIG. 5 shows a partial view of a shaft 28 and a connecting sleeve 34 used with the club head 10 of the present invention. The shaft 28 enters the club head 11 through the opening 25 in the airfoil ledge 22 and is positioned by the tubular shaped, connecting sleeve 34 having an upper collar 36 which anchors the sleeve 34 in the opening 25. The sleeve 34 extends below the opening into the interior of the club head 11 and may have an internal length from a minimum of 2 mm to a maximum of 20 mm. The sleeve 34 stabilizes the connection between the shaft 13 and the club head 11 and absorbs shock and vibration between the club head 11 and the shaft 13.

FIG. 6 shows an iron type golf club head 100 including a heel 102, toe 104, ball striking face 106, top ridge 108 and shaft connector 110. The shaft connector 110 includes an airfoil shaped ledge 112 having a bore opening 114 for a shaft and an airfoil shaped wall 114 which transitions into the top ridge 108. The shaft connector 110 is located below the top of the club head 100 which lessens wind resistance that causes drag. In addition the airfoil shape of the ledge and wall increase speed and create lift as the club head is swung.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A golf club including a club head and a shaft, said club head having an upper surface, a heel, a toe, bottom surface, ball striking face and rear surface wherein the improvement comprises:

a hosel-less, shaft to club head connection creating an aerodynamic airflow at said connection, said connection including a ledge generally parallel to and below said upper surface and having an airfoil shaped outer surface and an upright wall having an airfoil shaped surface connecting said ledge and said upper surface; and a shaft bore opening on said ledge for insertion and reception of the shaft connected to said club head.

2. The golf club of claim 1, further including a mounting sleeve in said bore opening.

3. The golf club of claim 1, wherein said ledge and said wall are progressively wider to narrower in a front to rear direction on said club head.

4. The golf club of claim 1, wherein said airfoil shaped outer surfaces of said ledge and said wall extend between said ball striking face and said rear surface.

5. The golf club of claim 1, wherein said opening is recessed below a surface of said ledge.

6. The golf club of claim 1, wherein said club head is a metalwood type golf club head.

7. The golf club of claim 1, wherein said club head is an iron type golf club head.

8. The golf club of claim 1 further including an internal sleeve extending downwardly from said shaft bore opening internal of said club head.

9. The golf club of claim 8 wherein said sleeve extends from a minimum of 2 mm to a maximum of 20 mm to absorb vibration and shock between the shaft and club head.

10. The golf club of claim 1 wherein said ledge and said wall form an L-shaped structure, said ledge and said wall being disposed at 90 degrees to each other.

* * * * *